United States Patent [19]

Chow et al.

[11] Patent Number: 4,826,085

[45] **Date of Patent: * May 2, 1989**

[54] ASPIRATION-TYPE SPRAYER WITH IMPROVED SAFETY FEATURE

[75] Inventors: Ho Chow, Cliffside Park; Joseph E. Testa, Woodcliff Lake, both of N.J.

[73] Assignee: Hunter-Melnor, Inc., Memphis, Tenn.

[ * ] Notice: The portion of the term of this patent subsequent to Jun. 14, 2005 has been disclaimed.

[21] Appl. No.: 154,311

[22] Filed: Feb. 10, 1988

[51] Int. Cl.[4] ..... B05B 7/28

[52] U.S. Cl. ..... 239/318

[58] Field of Search ..... 239/310, 313, 318, 10; 222/153; 215/330

[56] References Cited

U.S. PATENT DOCUMENTS

| | | | |
|---|---|---|---|
| 725,660 | 4/1902 | Biot | 251/105 |
| 959,090 | 5/1910 | Van Wickle | 251/104 |
| 1,043,281 | 11/1912 | Wilton | 251/105 |
| 2,149,611 | 3/1939 | Lohse . | |
| 2,293,390 | 8/1942 | Hengesbach . | |
| 2,369,326 | 2/1945 | Tirrell . | |
| 2,719,704 | 10/1955 | Anderson et al. . | |
| 2,827,193 | 3/1958 | Martin . | |
| 2,877,837 | 3/1959 | Alger | 239/322 |
| 2,926,857 | 3/1966 | Snyder . | |
| 2,948,480 | 8/1960 | Budwig . | |
| 3,032,274 | 5/1962 | Budwig . | |
| 3,042,314 | 7/1962 | Packard et al. . | |
| 3,204,875 | 9/1965 | Langstroth . | |
| 3,254,844 | 6/1966 | Blasnik et al. . | |
| 3,291,395 | 12/1966 | Sharp . | |
| 3,633,789 | 1/1972 | Markowitz | 215/9 |
| 3,698,584 | 10/1972 | Miller | 215/9 |
| 3,763,888 | 10/1973 | Duecker | 137/604 |
| 3,770,153 | 11/1973 | Gach et al. | 215/9 |
| 3,940,069 | 2/1976 | Gunzel et al. | 239/318 |
| 4,204,614 | 9/1978 | Reeve | 222/153 |
| 4,244,494 | 1/1981 | Colgate et al. | 239/313 X |
| 4,349,157 | 9/1982 | Beiswenger et al. | 239/500 |
| 4,369,921 | 1/1983 | Beiswenger et al. | 239/317 |
| 4,475,689 | 10/1984 | Hauger et al. | 239/318 |
| 4,545,535 | 10/1985 | Knapp | 239/313 |
| 4,750,674 | 6/1988 | Chow et al. | 239/318 |

FOREIGN PATENT DOCUMENTS 2446533 4/1975 Fed. Rep. of Germany .

*Primary Examiner*—Duane A. Reger
*Assistant Examiner*—Kevin P. Weldon
*Attorney, Agent, or Firm*—James & Franklin

[57] ABSTRACT

In an aspiration sprayer comprising a head permanently attached to the container in which the additive material is received and rotatable between operative positions one of which seals the interior of the container and the other of which unseals said interior and enables aspiration to occur, the container is provided with a plurality of recesses facing the head and the head is provided with a positioning and locking part resiliently urged toward those recesses, location of the part in a recess positioning the head in an operative position, at least that one of the recesses corresponding to the sealing position of the head and the locking part being so cooperatively shaped as to prevent rotation of the head until the part is manually removed from the recess, another of the recesses preferably being cooperatively shaped with respect to the part so that the head can be rotated relative to the container upon the application thereto of an appreciable rotational force without having to manually remove the part from the recess.

12 Claims, 2 Drawing Sheets

ASPIRATION-TYPE SPRAYER WITH IMPROVED SAFETY FEATURE

Figure 1:
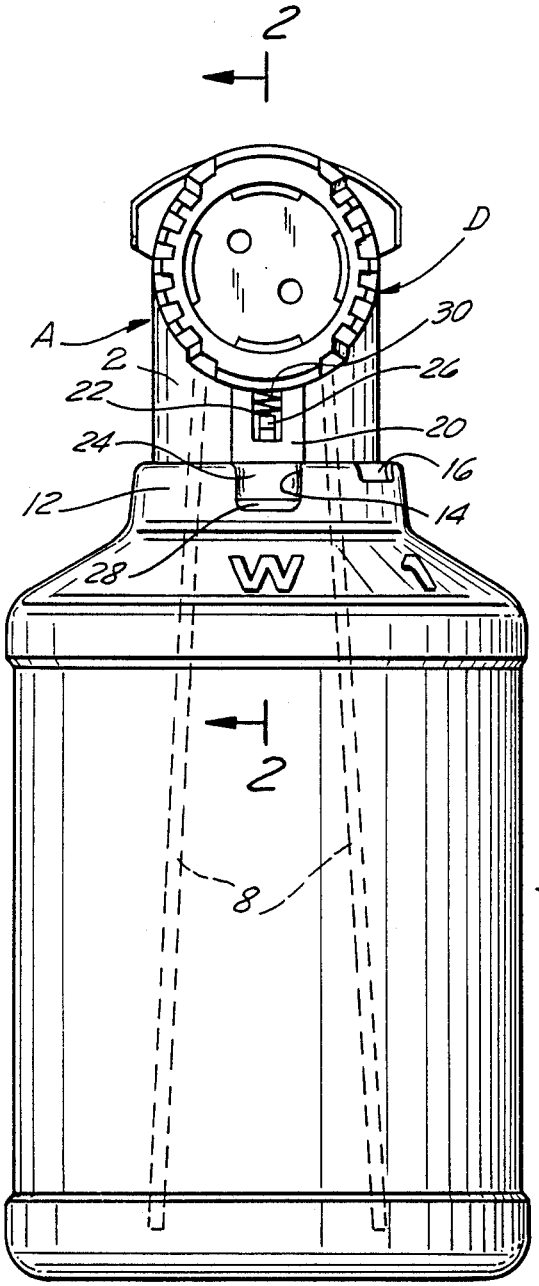

The present invention relates to the construction of an aspiration-type sprayer in which effective control of the presence or absence of the aspiration and the sealing of the container so that the contents thereof cannot escape is provided with a maximum of safety and convenience.

Aspiration-type sprayers are commonly used to mix relatively small quantities of an additive material with relatively large quantities of a carrier fluid such as water, the mixing being effected by causing the carrier fluid to pass rapidly over an opening which communicates with the interior of a container carrying the additive material and produce a suction effect which sucks the additive material into the stream of carrier fluid. This type of sprayer is frequently used in an agricultural environment, to apply chemicals of various types (e.g. pesticides) to bushes and trees. The present invention will be here disclosed as specially designed for such a use, with the additive material generally referred to as an insecticide, but it will be appreciated that it is not limited to such application, and that the additive material need not be an insecticide.

Quite frequently, particularly in agricultural applications, the additive substance to be sprayed is dangerous to humans, certainly if taken internally and frequently if applied externally. Many insecticides, commonly sprayed by homeowners, are of that character, and hence these substances are necessarily stored in household environments where they are exposed to children and thus constitute a very serious potential hazard.

Aspirating sprayers of the type under discussion have in the past been so constructed as to be attachable to and detachable from the containers for the insecticide or other material to be applied, so that when one container of insecticide has been emptied the sprayer can be removed and attached to another container. This is economically advantageous, but it also means that the containers of insecticide are of the openable type both before and after the sprayer has been put in place thereon. Thus the containers themselves, while on the household shelf waiting to be used, are hazardous, since a child may gain access thereto, remove the cap or sprayer, as the case may be, and thus be exposed to the insecticide.

In our co-pending application Ser. No. 901,311, filed Aug. 28, 1986, entitled "Aspiration-Type Sprayer", and assigned to the assignee of this application, now U.S. Pat. No. 4,750,674 of June 14, 1988, we have disclosed a sprayer which is permanently attached to the container for insecticide or the like, and is so associated therewith that it effectively seals the contents of the container, preventing spilling thereof or other access thereto by children or careless handlers, while at the same time enabling effective aspiration-type spraying to take place when desired. Since the sprayer and the container form a permanent combination the sprayer cannot be reused once the contents of the container have been exhausted—the container and the attached sprayer are simply discarded together. From a practical point of view this means that the sprayer must be sufficiently inexpensive to manufacture and assemble so that its permanent association with the container will be economically feasible.

These two requirements—efficient and reliable sealing and aspiration and ready selection between them on the one hand and low cost on the other hand—would appear to be antithetical, but by virtue of the construction disclosed in the said application those two requirements have been satisfactorily merged.

The construction of that application embodied an important safety feature, by virtue of which movement of the sprayer from its non-aspiration or sealing position to an aspiration position was strongly resisted by means requiring a relatively sophisticated type of manipulation to permit such movement to take place, thus effectively rendering the sprayer child-proof from a safety point of view. That safety feature involved compressing the depending portion of the head laterally, in a radial direction. While effective to achieve its desired result, that construction exhibited certain drawbacks—it was not sufficiently positive in its operation, and in practice it presented difficulties to the average adult user, in part with respect to how to manipulate the device and in part with respect to the amount of force required to properly manipulate it. Problems also arose with respect to providing a proper balance of strength and resiliency in the material to be deformed.

In accordance with the present invention those drawbacks are eliminated, and attainment of the desired safety locking feature is not compromised, by providing the container with a plurality of circumferentially spaced recesses which open upwardly toward the head and providing the head with a part resiliently urged downwardly toward and, when in proper registration, into an appropriate recess. The recess corresponding to the non-aspirating or sealed position of the head is so constructed in relation to the part that when the part is received therein rotation of the head out of its non-aspirating or sealing position is positively prevented, the part-recess cooperation resisting even strong attempts at rotating the head with respect to the container. When the part is in the non-aspiration or sealing recess the head cannot be rotated out of that position until the part is manually pulled out from the recess, that manipulation producing the desired child-proof locking effect. The cooperation between the part and the recess or recesses corresponding to aspiration-type positions of the head is preferably different, the recess-part cooperation in those situations serving to retain the head in its aspiration position but yielding when force is exerted on the head in a turning direction.

It is therefore an object of the present invention to provide, in an aspiration-type sprayer in which the sprayer head is rotatably mounted on the container for the material to be aspiration-sprayed, means for securely locking the head in its sealing position and enabling the head to be moved therefrom only by a type of manipulation which is effectively child-proof, and to do so by means of a structure which is reliable, inexpensive and easily manufactured and assembled, and for locating the head in its aspiration position when that is desired.

Figure 3:
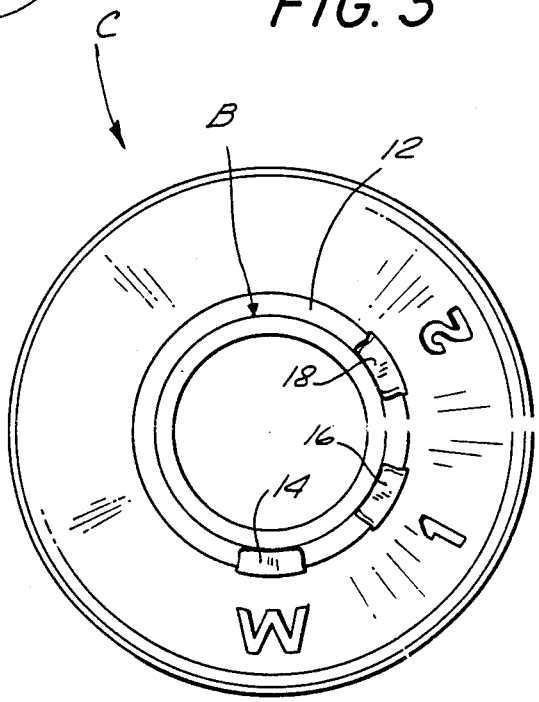
Figure 2:
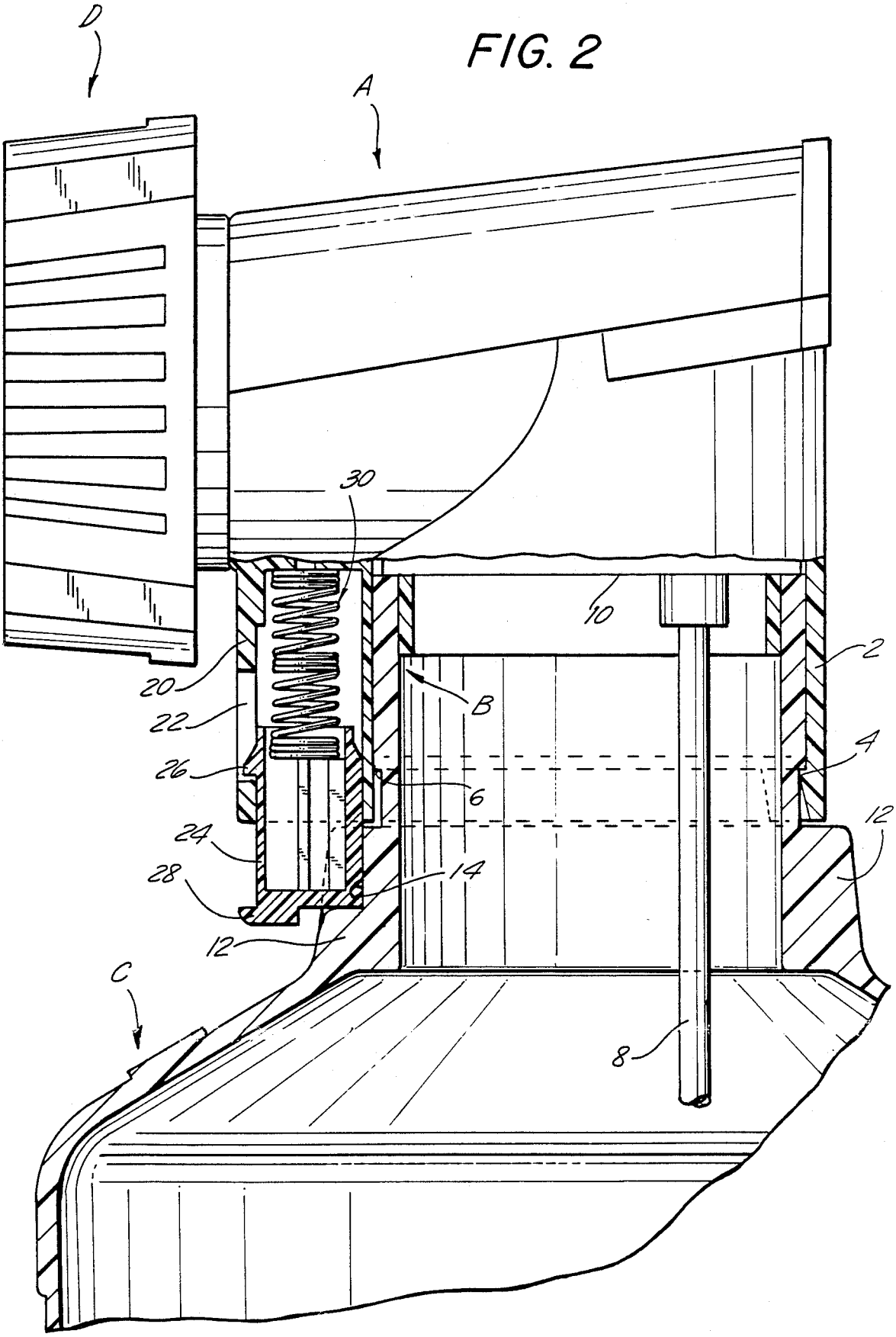

To the accomplishment of the above, and to such other objects as may hereinafter appear, the present invention relates to improved means of locating the rotatable head of an aspiration-type sprayer in its operative positions and providing a safety locking feature thereto in its sealing position, as defined in the appended claims and as described in this specification taken together with the accompanying drawings in which FIG. 1 is a front elevational view of the sprayer of the present invention in position on a container;

FIG. 2 is a fragmentary elevational view thereof on an enlarged scale, a portion thereof being cross-sectioned along the line 2—2 of FIG. 1, and FIG. 3 is a top plan view of the container with the sprayer removed therefrom.

The sprayer head, generally designated A, is designed to be permanently mounted on the neck B of a container C for the material, such as an insecticide, to be sprayed. The carrier fluid, in the embodiment here disclosed, is a stream of water coming from, for example, a garden hose (not shown) adapted to be secured to the sprayer head A by a coupling nut generally designated D.

The construction of the container and the sprayer head may, except as here specifically described, be the same as that of the sprayer of our aforementioned copending application Ser. No. 901,311, the contents of which are here incorporated by reference. Thus the sprayer head A is provided with a cylindrical depending wall 2 provided on its inner surface with a plurality of circumferentially spaced inwardly extending lugs 4 having radially inwardly and upwardly extending surfaces terminating in axially upwardly facing ledges, that wall 2 telescoping over the container neck B, the neck being provided with a lower surface defining a downwardly facing ledge 6, the parts 4 and 6 cooperating, when the wall 2 is telescoped over the container neck B, to permanently non-removably mount the sprayer head A on the container neck B while permitting the head A to be rotated about the axis of the neck B.

The container C carries one or more dip tubes 8 extending into its interior and carried by a fixed structure 10 mounted on the container neck B. The head A is rotatable relative to the neck B between operative positions in one of which the interior of the container C is sealed off and flow of water through head A produces no aspiration effect and in others of which the interior of the container is unsealed with respect to the aspiration head and flow of water through that head A aspirates the contents of the container into that water as it is sprayed from the head. The means for effecting that sealing, unsealing and aspiration may involve the specific structure disclosed in our aforementioned application Ser. No. 901,311 or may take other forms. What is significant is that when the head is in its first or sealing operative position the contents of the container are held inviolate and the environment and the users of the device are protected therefrom. It therefore is important that when the head is in that sealing operative position it be positively retained there against accidental dislocation or the actions of a child or other unauthorized user of the sprayer.

Immediately below the neck B of the container is a widened part 12 extending radially out behind the sprayer wall 2, and that part 12 is provided with a plurality of circumferentially spaced upwardly opening recesses 14, 16 and, in the embodiment here specifically disclosed where the head A has two different operative aspiration positions, a third recess 18. The recess 14, which corresponds to the sealing and non-aspiration rotational position of the head A and hence is arbitrarily designated "W" (for "Water Only"), is deeper than the recesses 16 and 18, which correspond to the two aspiration operative positions of the head A and therefore are designated "1" and "2" respectively. The recess 14 is also provided with substantially abrupt side walls, whereas the side walls of the recesses 16 and 18 are shallow and shaped so as to facilitate the ready escape of a cooperating part therefrom when the head A is rotated. This can be accomplished, for example, by sloping the side walls or by rounding the corner that those walls make with the bottom wall of the recess.

The wall 2 of the head A is provided with an outwardly protruding housing 20 which is provided on its outer wall with a slot 22 closed at its bottom. A positioning and locking part 24 is slidably mounted within the housing 20 for vertical movement, it has an outward protuberance 26 received within the slot 22, and it is provided at its lower end with a lip 28. A spring 30 is received within housing 20 above the part 24 and is retained in compressed position by the part 24, the spring thus urging the part 24 downwardly, its downward movement being positively limited by engagement of the protuberance 26 with the closed bottom of the slot 22. The shape of that portion of the part 24 which extends down from the housing 20 is such as to fit within the recesses 14, 16 and 18 and to cooperate therewith to rotationally locate the head A.

When the head A is in its sealing or non-aspirating rotational position on the neck B of the container C the housing 20 is located above, and the part 24 is spring-urged into, the recess 14, and the abruptness of the side walls of that opening in combination with the shape of the part 24 produces a positive lock on the rotative position of the head A. All non-destructive attempts to rotate the head A with respect to the container C will be ineffectual unless and until the part 24 is lifted against the action of the spring 30, as by grasping the underside of the lip 28 and lifting it until the lower surface of the part 24 is above the upper surface of the container part 12. Once the head A is then rotated with respect to the container C so as to move the part 24 out of registration with the recess 14 the part 24 may be released, the spring 30 will urge it down against the upper surface of the container part 12, and the part 24 will slide over that upper surface as the head A is rotated until the head reaches its first aspiration position. At that point the part 24 will be in registration with the recess 16 and the spring 30 will urge it down into that opening, thus positively locating the head A in its first operative aspiration position.

When it is desired to rotate the head A to another position, either to its second operative aspiration position corresponding to the recess 18 or back to its sealing or non-aspirating position corresponding to the recess 14, the part 24 and the recess 16 must be disengaged. This can be accomplished in the same fashion as that disengagement was accomplished when the part 24 was in the recess 14, that is to say, by manually lifting the part 24 against the action of the spring 30. It may also preferably be accomplished, as is here specifically disclosed, by so cooperatively shaping the part 24 and the recess 16 that the exertion of a substantial rotational force on the head A will cam the part 24 out of the recess 16. To that end the side walls of the recess 16 are shallow and shaped to a desirable degree. The recess 18 may be correspondingly shaped like recess 16, or, if desired, its side wall directed away from the recess 16 may be abrupt and not sloped, so that normal manipulation by attempting to turn the head A will be effective only to rotate it back toward its sealing position.

Hence the part 24 positions the head A in each of its operative positions and locks it in its sealing, non-aspirating position, thus providing the desired child-proof safety feature, by means of structure which is simple, sturdy, inexpensive to manufacture and assemble, and positive and reliable in operation. If the positioning effect of the recesses 14, 16 and 18 is not sufficiently precise, additional positioning means may be provided inside the apparatus to provide the desired precision, such as is disclosed in the aforementioned application Ser. No. 901,311.

While but a single embodiment of the present invention has been here specifically disclosed, it will be apparent that many variations may be made therein, all within the spirit of the invention as defined in the following claims.

We claim:

1. In a chemical sprayer, a container for the chemical to be sprayed, an aspiration assembly comprising a structure having an aspiration means adapted to communicate with the interior of said container and means for guiding a flow of fluid past said aspiration means and out from said structure, means for permanently and rotatably mounting and securing said structure on said container, and positioning means for said structure, said positioning means comprising a plurality of recesses in said container exposed at the exterior thereof near said structure and circumferentially spaced to correspond to different operative rotational positions of said structure, a positioning and locking part movably mounted on said structure and extending therefrom in the direction of said recesses, and means active on said part to bias it toward and into said recesses, whereby the engagement of said part in a recess as urged by said biasing means locates and holds said structure in one of its operative positions and movement of said part out of said recess against the action of said biasing means permits said structure to be rotated to another operative position.

2. The sprayer of claim 1, in which said aspiration assembly, when in said one of said positions, seals access to the contents of said container.

3. The chemical sprayer of either of claims 1 or 2, in which said recesses are exposed at their upper ends and said part is biased downwardly thereinto.

4. The chemical sprayer of either of claims 1 or 2, in which said recesses are exposed at their upper ends and said part is biased downwardly thereinto, said structure comprising an open-bottomed housing in which said part is received, with respect to which it moves, and from which it extends, and a spring in said housing and comprising said biasing means.

5. The chemical sprayer of either of claims 1 or 2, in which said recesses are exposed at their upper ends and said part is biased downwardly thereinto, said structure comprising an open-bottomed housing in which said part is received, with respect to which it moves upwardly and downwardly, and from which it extends, and a spring in said housing and comprising said biasing means, said housing having a vertically extending restricted-bottom slot and said part having an extension slidable in said slot as said part moves upwardly and downwardly with respect to said housing, said restricted bottom of said slot limiting the extent to which said part can move downwardly with respect to said housing.

6. In a chemical sprayer, a container for the chemical to be sprayed, an aspiration assembly comprising a structure having an aspiration means adapted to communicate with the interior of said container and means for guiding a flow of fluid past said aspiration means and out from said structure, means for permanently and rotatably mounting and securing said structure on said container, and positioning means for said structure, said positioning means comprising a plurality of recesses in said container exposed at the exterior thereof near said structure and circumferentially spaced to correspond to different operative rotational positions of said structure, a positioning and locking part movably mounted on said structure and extending therefrom in the direction of said recesses, and means active on said part to bias it toward and into said recesses, whereby the engagement of said part in a recess as urged by said biasing means locates and holds said structure in one of its operative positions and movement of said part out of said recess against the action of said biasing means permits said structure to be rotated to another operative position, in which one of said recesses is deeper than the others, whereby it is more difficult to rotate said structure to another operative position when said part is received therein.

7. The sprayer of claim 6, in which said aspiration assembly, when in said one of said positions, seals access to the contents of said container, and in which said one of said recesses corresponds to said one of said positions.

8. In a chemical sprayer, a container for the chemical to be sprayed, an aspiration assembly comprising a structure having an aspiration means adapted to communicate with the interior of said container and means for guiding a flow of fluid past said aspiration means and out from said structure, means for permanently and rotatably mounting and securing said structure on said container, and positioning means for said structure, said positioning means comprising a plurality of recesses in said container exposed at the exterior thereof near said structure and circumferentially spaced to correspond to different operative rotational positions of said structure, a positioning and locking part movably mounted on said structure and extending therefrom in the direction of said recesses, and means active on said part to bias it toward and into said recesses, whereby the engagement of said part in a recess as urged by said biasing means locates and holds said structure in one of its operative positions and movement of said part out of said recess against the action of said biasing means permits said structure to be rotated to another operative position, in which one of said recesses is deeper than the others and is provided with steep sides, whereas another recess is provided with shallow and shaped sides, whereby it is more difficult to lift said part from said one recess than from the other and rotation of said structure from its operative position corresponding to said one recess is prevented unless said part is manually withdrawn from said one recess, whereas rotation of said structure from its operative position corresponding to said other recess is impeded by the cooperation between said part and said other recess but is not prevented thereby.

9. The sprayer of claim 8, in which one of said recesses is deeper than the others, whereby it is more difficult to rotate said structure to another operative position when said part is received therein, and in which said one of said recesses corresponds to said one of said positions.

10. The chemical sprayer of any of claims 6–9, in which said recesses are exposed at their upper ends and said part is biased downwardly thereinto.

11. The chemical sprayer of any of claims 6–9, in which said recesses are exposed at their upper ends and said part is biased downwardly thereinto, said structure comprising an open-bottomed housing in which said part is received, with respect to which it moves, and from which it extends, and a spring in said housing and comprising said biasing means.

12. The chemical sprayer of any of claims 6–9, in which said recesses are exposed at their upper ends and said part is biased downwardly thereinto, said structure comprising an open-bottomed housing in which said part is received, with respect to which it moves upwardly and downwardly, and from which it extends, and a spring in said housing and comprising said biasing means, said housing having a vertically extending restricted-bottom slot and said part having an extension slidable in said slot as said part moves upwardly and downwardly with respect to said housing, said restricted bottom of said slot limiting the extent to which said part can move downwardly with respect to said housing.

* * * * *